US005417344A

United States Patent [19]

Wells et al.

[11] Patent Number: 5,417,344

[45] Date of Patent: May 23, 1995

[54] SECONDARY CONTAINMENT APPARATUS WITH SUPPORT AND CLAMP

[76] Inventors: William E. Wells, 3400 S. Preble County Line Rd., West Alexandria, Ohio 45381; Michael H. Huffman, 121 W. Main St., Tipp City, Ohio 45371; David R. Mattix, 2316 DeCliff Rd. North, New Bloomington, Ohio 43341

[21] Appl. No.: 165,348

[22] Filed: Dec. 13, 1993

[51] Int. Cl.[6] ..... B65D 25/24

[52] U.S. Cl. ..... 220/571; 220/562; 220/1.5; 220/23.83; 248/129; 280/79.5

[58] Field of Search ..... 280/79.5 X, 47.26; 410/47, 48, 51; 414/622; 248/129; 220/562, 571, 1.5, 23.83, 23.86, 4.12, 4.21, 400, 408, 445, 737, 740

[56] References Cited

U.S. PATENT DOCUMENTS

| | | | |
|---|---|---|---|
| 211,735 | 1/1879 | Hinman | 220/562 |
| 454,448 | 6/1891 | Barley | 280/79.5 |
| 1,738,096 | 12/1929 | Cole | 248/129 |
| 2,531,159 | 11/1950 | Rowell | 220/571 |
| 2,787,397 | 7/1953 | Radford | 220/5 |
| 2,944,563 | 7/1960 | DeBlasio et al. | 137/312 |
| 3,119,238 | 2/1963 | Chamberlain et al. | 62/54 |
| 3,374,004 | 3/1968 | Oliver | 280/47.26 |
| 4,085,773 | 4/1978 | Tinney | 137/571 |
| 4,391,863 | 7/1983 | Bonis | 428/35 |
| 4,815,621 | 3/1989 | Bartis | 220/1 |
| 4,842,139 | 6/1989 | Krieg | 206/386 |
| 4,871,081 | 10/1989 | Ershig | 220/5 |
| 4,884,711 | 12/1989 | Bomhard et al. | 220/5 |
| 4,895,272 | 1/1990 | DeBenedittis et al. | 220/85 |
| 4,934,553 | 6/1990 | McCarthy | 220/454 |
| 4,939,833 | 7/1990 | Thomas | 29/401 |
| 5,000,467 | 3/1991 | Becca | 248/129 |
| 5,005,729 | 4/1991 | Hollman | 220/23.83 |
| 5,042,683 | 8/1991 | Shaw et al. | 220/408 |
| 5,082,034 | 1/1992 | Soper | 141/88 |
| 5,088,530 | 2/1992 | Harp | 141/86 |
| 5,122,027 | 6/1992 | Tabayashi | 414/622 |
| 5,201,432 | 4/1993 | Elvin-Jensen | 220/1.5 |
| 5,294,145 | 3/1994 | Cheng | 414/622 |

FOREIGN PATENT DOCUMENTS 2169338 7/1986 United Kingdom .

*Primary Examiner*—Stephen J. Castellano

*Attorney, Agent, or Firm*—Killworth, Gottman, Hagan & Schaeff

[57] ABSTRACT

A secondary containment apparatus for storing a primary container is provided wherein the secondary containment apparatus is tilted into the vertical position to load the primary container. The secondary containment apparatus has a base member defining a liquid impermeable chamber, a support mounted in the chamber and a container catch mechanism for securing the primary container to the support when the secondary containment apparatus is in the vertical position such that the primary container is properly mounted therein upon returning the secondary containment apparatus to the horizontal position. A lid member is preferably provided which engages with the base member to enclose the primary container.

16 Claims, 3 Drawing Sheets

SECONDARY CONTAINMENT APPARATUS WITH SUPPORT AND CLAMP

BACKGROUND OF THE INVENTION

The present invention relates generally to a secondary containment apparatus for storing primary containers and, more particularly, to a secondary containment apparatus which entraps accidental spillage from the primary container, which provides facile loading of the primary container, which completely encloses the primary container and which may be easily transported from place to place.

Our industrial society produces and uses enormous quantities of environmentally hazardous materials which must be stored, transported and disposed of in a safe manner. As a result, government agencies have set forth numerous regulations governing the handling of such materials. A key component in the regulatory scheme for safely handling such materials is the use of secondary containment units to entrap any leakage or spillage from primary storage containers, such as large drums, before the hazardous materials can pollute the surrounding environment.

Various secondary containment units are known in the art. U.S. Pat. No. 5,042,683, for example, is directed to a secondary containment unit having a base member and two interlocking lid members for storing one or more primary containers. The two lid members are slidably mounted on the base member such that they interlock substantially in the middle of the base member. Thus, the lid members are forced apart to allow access to the interior of the unit and locked together to completely enclose the primary container. The base member is equipped with legs to facilitate transport of the unit by a forklift or the like. Additionally, wheels or casters may be provided on the base member for moving the unit.

U.S. Pat. No. 4,361,232 discloses a secondary containment unit for storing large drums wherein the unit is comprised of pan and a removable lid which fits over the pan. The lid simply rests on top of the pan with the sides of the lid extending over the pan edges. Consequently, the lid must be completely removed before the enclosed drums can be removed. In addition, a gasket must be transposed between the lid and the pan to seal against overflow material and environmental elements.

In the aforementioned secondary containment units, the primary container must be manually or with a separate mechanized device be loaded into the unit. This operation may foreseeably result in employee fatigue and dissatisfaction in manually loading the container or in the purchase, maintenance and storage of expensive mechanized lifting devices.

Thus, there is a need for a secondary containment unit for storing a primary container which provides facile loading of the primary container into the unit, which completely encloses the primary container and which may be easily transported.

SUMMARY OF THE INVENTION

The present invention provides a secondary containment apparatus designed to satisfy the aforementioned need. The secondary containment apparatus is initially tilted upward into a vertical position to facilitate loading of the primary container. A barrel catch mechanism secures the primary container to the secondary container apparatus such that the secondary container apparatus may be returned to the horizontal position with the primary container secured therein.

In accordance with one aspect of the present invention, a secondary containment apparatus for storing a primary container is provided. The secondary containment apparatus includes a base member having a bottom base wall, end base walls and side base walls which define a liquid impermeable chamber. The base member is capable of tilting upward into a vertical position to permit loading of the primary container. A support, which preferably defines a plurality of guide apertures, is mounted in the chamber for supporting the primary container. A container catch mechanism which is slidably mounted in the guide apertures of the support secures the primary container against the support whereby the base member can be returned to a horizontal position with the primary container contained therein.

Preferably, wheels are mounted on the base member for moving the secondary containment apparatus. To facilitate loading of the primary container, at least one lifting plate is mounted on one of the end base walls of the base member. When loading the primary container, the lifting plates are inserted under the primary container.

The secondary containment apparatus may also include a lid member having a top lid wall, end lid walls and side lid walls for engaging with the base member to substantially completely enclose the primary container. At least one of the end lid walls may extend beyond a corresponding one of the end base walls of the base member when the lid member is engaged with the base member to provide for air flow into the chamber. Further, at least one of the side lid walls of the lid member may have a curved flange portion and a corresponding one of the side base walls of the base member has a rolled lip portion which engages the curved flange portion when the lid member is engaged with the base member.

Preferably, the support of the secondary containment apparatus includes a plurality of cross beams mounted substantially horizontally between the side base walls of the base member and a plurality of support beams mounted substantially vertically between the bottom base wall and the plurality of cross beams for providing support for the plurality of cross beams. A plurality of grooved members each mounted on an associated one of the plurality of cross beams supports and secures the primary container.

The container catch mechanism may comprise a plurality of support members slidably mounted in a plurality of guide apertures defined by the support. A cross member interconnects the plurality of support members and at least one latch hook is mounted on at least one of the plurality of support members for engaging the primary container. For a primary container having a raised rim portion, the latch hook may engage the raised rim portion.

In accordance with another aspect of the present invention, a secondary containment apparatus for storing a primary container includes a base member having a bottom base wall, end base walls and side base walls which define a liquid impermeable chamber. The base member is capable of tilting upward into a vertical position to load the primary container. A support which defines a plurality of guide apertures is mounted in the chamber for supporting the primary container. A container catch mechanism is slidably mounted on the support for securing the primary container against the support whereby the base member can be returned to a horizontal position with the primary container supported on the support.

The container catch mechanism includes a plurality of support members slidably mounted in the plurality of guide apertures. A cross member interconnects the plurality of support members. At least one latch hook is mounted on at least one of the plurality of support members for engaging the primary container.

The support may further include a plurality of cross beams mounted substantially horizontally between the side base walls of the base member. A plurality of support beams are mounted substantially vertically between the bottom base wall and the plurality of cross beams for providing support for the plurality of cross beams. A plurality of grooved members each mounted on an associated one of the plurality of cross beams supports and secures the primary container. At least one lifting plate may be mounted on one of the end base walls of the base member for insertion under the primary container when the base member is in the vertical position to assist in loading the primary container.

Accordingly, it is an object of the present invention to provide a secondary containment apparatus for storing a primary container which allows facile loading and unloading of the primary container, which completely encloses the primary container and which may be easily moved.

DETAILED DESCRIPTION OF THE INVENTION

Figure 1:
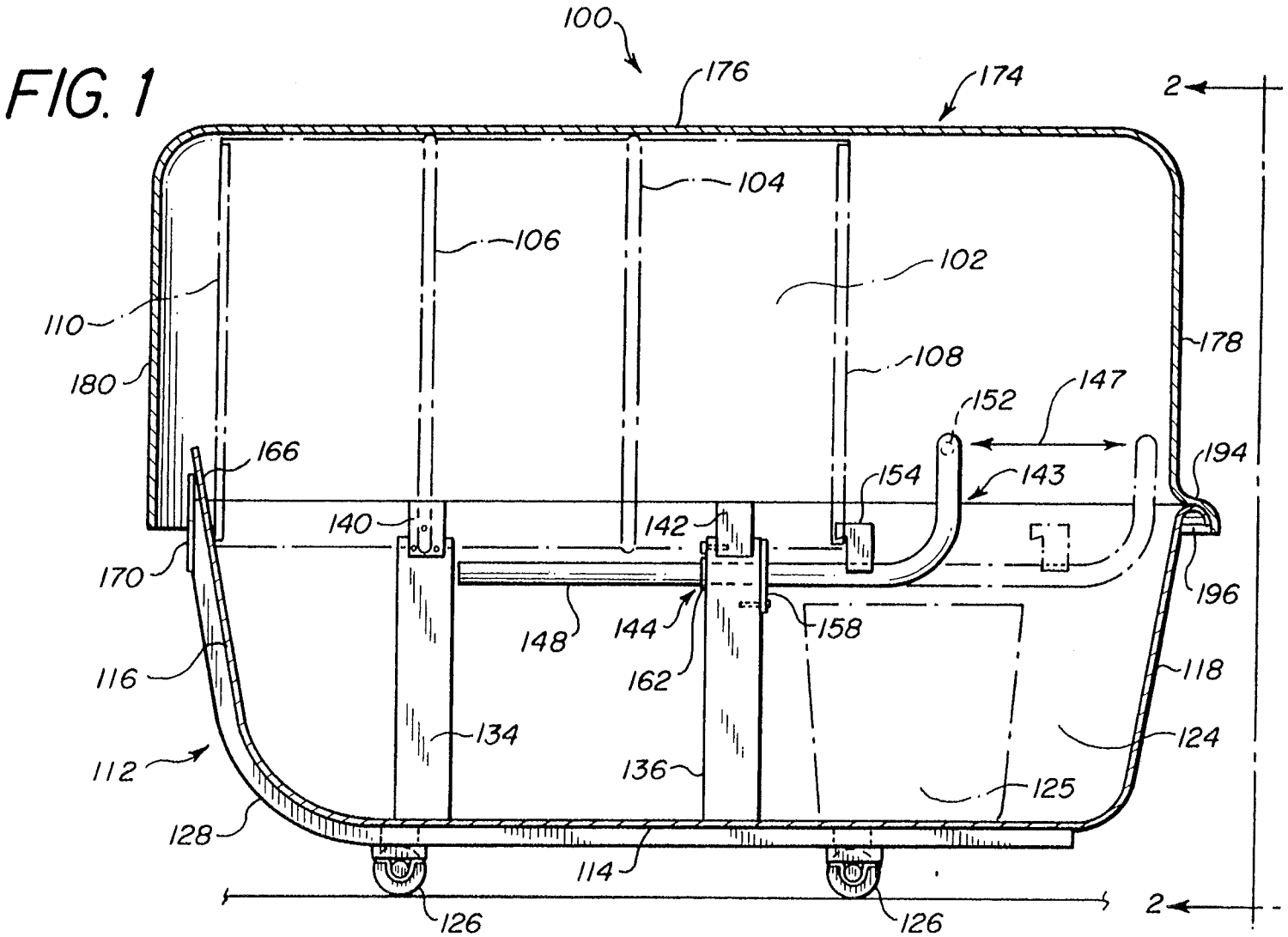
FIG. 1 is a side, longitudinal sectional view of the secondary containment apparatus including a base member and a lid member in accordance with the present invention.

A secondary containment apparatus 100 for storing a primary container 102 in accordance with the invention is shown in FIG. 1. The primary container 102 has two raised ribs 104, 106 and two raised rim portions 108, 110. As will be readily apparent from the description hereinbelow, the design of the primary container 102 is shown only for illustrative purposes. Consequently, it should be understood that other primary container designs may be advantageously employed in the invention.

A base member 112 having a bottom base wall 114, end base walls 116, 118 and side base walls 120, 122 defines a liquid impermeable chamber 124 which entraps accidental spillage from the primary container 102. To ease disposal of any spillage, a removable container 125 may be positioned within the chamber 124. Wheels 126, pairs of which may be interconnected by an axle 127, are mounted on the bottom base wall 114 of the base member 112 to facilitate movement of the secondary containment apparatus 100. The end wall 116 of the base member 112 is slightly arcuate such that the base member 112 may be tilted upward into a vertical position to permit facile loading of the primary container 102 into the secondary containment apparatus 100. A support strip 128 may be mounted along the bottom base wall 114 and the end base wall 116 to increase the structural integrity of the base member 112.

Figure 2:
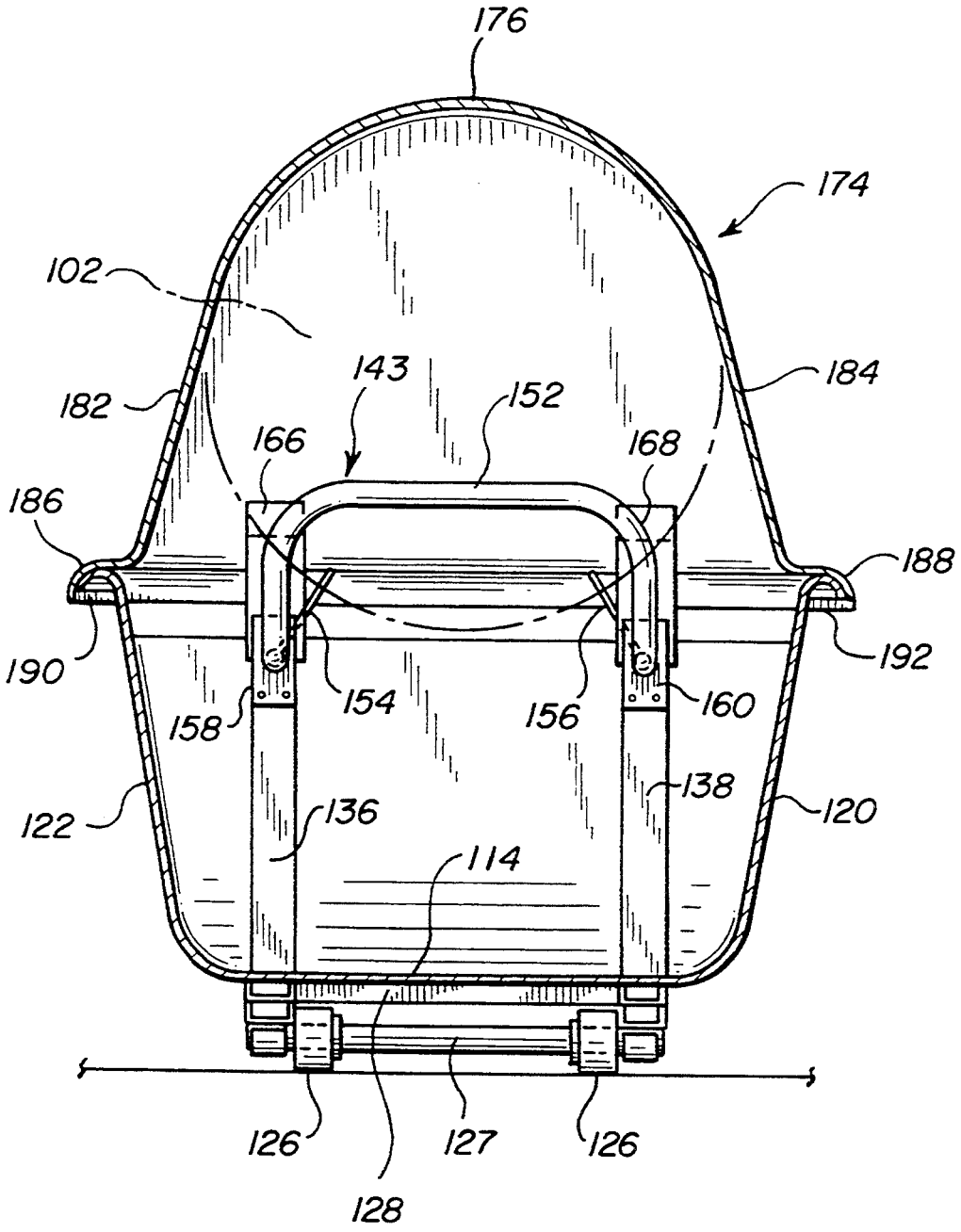
FIG. 2 is a front sectional view taken along axis 2—2 of the secondary containment apparatus in accordance with the present invention.
Figure 3:
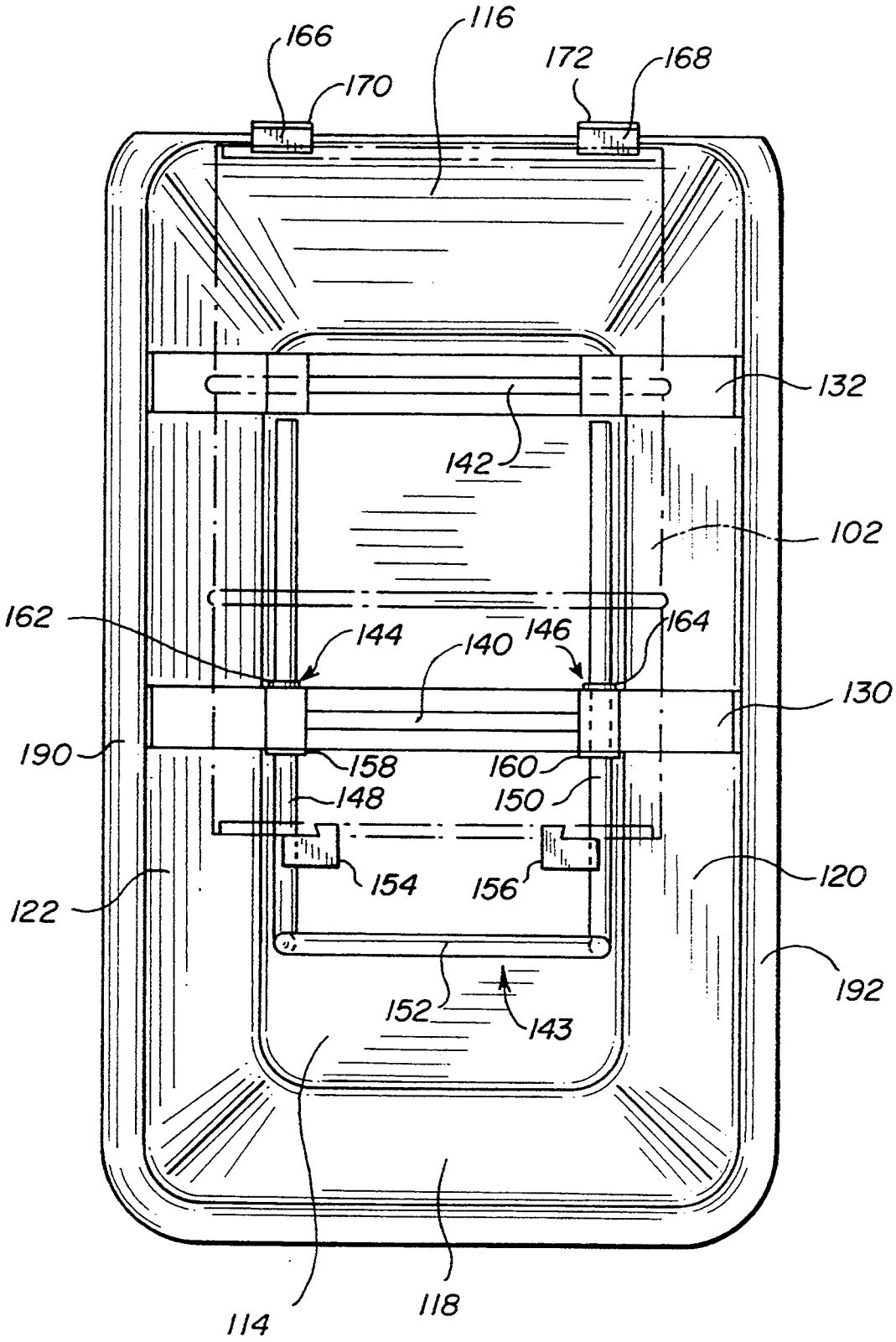
FIG. 3 is a top view of the base member of the secondary containment apparatus in accordance with the present invention.

A support for supporting the primary container 102 is mounted in the chamber 124. The support preferably consists of cross beams 130, 132 mounted substantially horizontally between the side base walls 120, 122 of the base member 112, as shown in FIG. 3. A plurality of generally vertical support beams 134, 136, 138 mounted on the bottom base wall 114 support the cross beams 130, 132. Although only three support beams are shown in FIGS. 1–3, it should be understood that four support beams are preferred. Grooved members 140, 142 are mounted on respective cross beams 130, 132. The grooved members 140, 142 provide a secure seat for the primary container 102 and, thereby restrict the movement of the primary container 102 on the support.

A container catch mechanism, generally designated by reference numeral 143, is slidably mounted in guide apertures 144, 146 in the support. The container catch mechanism 143 secures the primary container 102 against the support during loading of the primary container 102 into the secondary containment apparatus 100. Movement of the container catch mechanism 143 is represented by arrow 147. The container catch mechanism 143 consists of support members 148, 150 slidably mounted in respective guide apertures 144, 146. A cross member 152 interconnects the support members 148, 150. Mounted on the respective support members 148, 150 are latch hooks 154, 156 for engaging the primary container 102. Preferably, the latch hooks 154, 156 engage the raised rim portion 108 of the primary container 102.

To provide further structural integrity, flat plates 158, 160 having apertures which are aligned with the guide apertures 144, 146 may be mounted on the support beams 136, 138. Bushings 162, 164 may be provided in the guide apertures 144, 146 to facilitate the sliding movement of the support members 148, 150 and reduce wear on the support beams 136, 138.

Lifting plates 166, 168 are mounted on the end base wall 116 of the base member 112. When the base member 112 is in the vertical position, the lifting plates 166, 168 are inserted under the primary container 102 to assist in the loading thereof. Backing plates 170, 172 are mounted contiguous to the respective lifting plates 166, 168 to provide additional support.

A lid member 174 may be provided to enclose the primary container 102 and, thereby protect the primary container 102 from the external elements, such as rain and snow. The lid member 174 consists of a top lid wall 176, end lid walls 178, 180 and side lid walls 182, 184. When the lid member 174 is positioned on the base member 112, the end lid wall 180 extends beyond the end base wall 116 to permit air flow in the chamber 124. The side lid walls 182, 184 of the lid member 174 may have curved flange portions 186, 188 which engage corresponding rolled lip portions 190, 192 formed in the side base walls 120, 122. Similarly, the end lid wall 178 of the lid member 174 may have a curved flange portion 194 which engages a corresponding rolled lip portion 196 formed in the end base wall 118. The corresponding curved flange portions 186, 188, 194 and rolled lip portions 190, 192, 196 assume a tight seal between the lid member 174 and the member 112.

During loading of the secondary containment apparatus 100, a worker initially tilts the base member 112 into the vertical position. The container catch mechanism 143 is moved upward until the primary container 102 can be placed against the grooved members 140, 142 of the support. An edge of the primary container 102, which is in the upright position, is moved onto the lifting plates 166, 168. The container catch mechanism 143 is then lowered until the latch hooks 154, 156 engage the raised rim portion 108 of the primary container 102. The latch hooks 154, 156 thus prohibit the primary container 102 from lifting off the grooved members 140, 142. The base member 112 is returned to the horizontal position with the primary container 102 supported on the grooved members 140, 142.

Thereafter, the lid member 174 may be positioned on the base member 112 to enclose the primary container 102. To allow access to the primary container 102, the container catch mechanism 143 is moved away from the primary container 102. The secondary containment apparatus 100 thus provides facile loading of the primary container, completely encloses the primary container and is easily transported.

Having thus described the invention in detail by way of reference to preferred embodiments thereof, it will be apparent that other modifications and variations are possible without departing from the scope of the invention defined in the appended claims. For example, the lid member may have design configurations which depart from those described herein.

What is claimed is:

1. A secondary containment apparatus for storing a primary container comprising:
- a base member having a bottom base wall, end base walls and side base walls which define a liquid impermeable chamber, said base member being capable of tilting upward into a vertical position to permit loading of the primary container;
- a support mounted in said chamber for supporting the primary container; and
- a container catch mechanism slidably mounted on said support for securing the primary container against said support whereby said base member can be returned to a horizontal position with the primary container supported on said support.

2. The secondary containment apparatus as recited in claim 1 further comprising wheels mounted on said base member for moving said apparatus.

3. The secondary containment apparatus as recited in claim 1 comprising at least one lifting plate mounted on one of said end base walls of said base member for insertion under the primary container when said base member is in the vertical position to assist in loading the primary container.

4. The secondary containment apparatus as recited in claim 1 wherein said support defines a plurality of guide apertures and said container catch mechanism is slidably mounted in said guide apertures for engaging the primary container.

5. The secondary containment apparatus as recited in claim 1 comprising a lid member having a top lid wall, end lid walls and side lid walls, said lid member engaging with said base member to substantially completely enclose the primary container.

6. The secondary containment apparatus as recited in claim 5 wherein said lid member has at least one of said end lid walls which extends beyond a corresponding one of said end base walls of said base member when said lid member is engaged with said base member to provide for air flow into said chamber.

7. The secondary containment apparatus as recited in claim 6 wherein at least one of said side lid walls of said lid member has a curved flange portion and a corresponding one of said side base walls of said base member has a rolled lip portion which engages said curved flange portion when said lid member is engaged with said base member.

8. The secondary containment apparatus as recited in claim 1 wherein said support comprises:
- a plurality of cross beams mounted substantially horizontally between said side base walls of said base member;
- a plurality of support beams mounted substantially vertically between said bottom base wall and said plurality of cross beams for providing support for said plurality of cross beams; and
- a plurality of grooved members each mounted on an associated one of said plurality of cross beams for supporting and securing the primary container.

9. The secondary containment apparatus as recited in claim 1 wherein said support defines a plurality of guide apertures and said container catch mechanism comprises:
- a plurality of support members slidably mounted in said plurality of guide apertures;
- a cross member interconnecting said plurality of support members; and
- at least one latch hook mounted on at least one of said plurality of support members for engaging the primary container.

10. The secondary containment apparatus as recited in claim 9 wherein the primary container has a raised rim portion and said at least one latch hook is capable of engaging said raised rim portion.

11. A secondary containment apparatus for storing a primary container, said apparatus comprising:
- a base member having a bottom base wall, end base walls and side base walls which define a liquid impermeable chamber, said base member being capable of tilting upward into a vertical position to load the primary container;
- a support mounted in said chamber for supporting the primary container, said support defining a plurality of guide apertures;
- a container catch mechanism slidably mounted on said support for securing the primary container against said support whereby said base member can be returned to a horizontal position with the primary container supported on said support, said container catch mechanism comprising,
  - a plurality of support members slidably mounted in said plurality of guide apertures,
  - a cross member interconnecting said plurality of support members, and
  - at least one latch hook mounted on at least one of said plurality of support members for engaging the primary container; and
- at least one lifting plate mounted on one of said end base walls of said base member for insertion under the primary container when said base member is in the vertical position to assist in loading the primary container.

12. The secondary containment apparatus as recited in claim 11 further comprising wheels mounted on said base member for moving said apparatus.

13. The secondary containment apparatus as recited in claim 11 comprising a lid member having a top lid wall, end lid walls and side lid walls, said lid member engaging with said base member to substantially completely enclose the primary container.

14. The secondary containment apparatus as recited in claim 13 wherein said lid member has at least one of said end lid walls which extends beyond a corresponding one of said end base walls of said base member when said lid member is engaged with said base member to provide for air flow into said chamber.

15. The secondary containment apparatus as recited in claim 14 wherein at least one of said side lid walls of said lid member has a curved flange portion and a corresponding one of said side base walls of said base member has a rolled lip portion which engages said curved flange portion when said lid member is engaged with said base member.

16. The secondary containment apparatus as recited in claim 11 wherein said support comprises:

a plurality of cross beams mounted substantially horizontally between said side base walls of said base member;

a plurality of support beams mounted substantially vertically between said bottom base wall and said plurality of cross beams for providing support for said plurality of cross beams; and a plurality of grooved members each mounted on an associated one of said plurality of cross beams for supporting and securing the primary container.

* * * * *